US005449470A

United States Patent [19]

Cahoon et al.

[11] Patent Number: 5,449,470

[45] Date of Patent: Sep. 12, 1995

[54] OVERBASED ALKALI SALTS AND METHODS FOR MAKING SAME

[75] Inventors: John M. Cahoon, Mentor; Jack L. Karn, Richmond Heights; Mary F. Salomon, Mayfield Village; Craig D. Tipton, Perry, all of Ohio

[73] Assignee: The Lubrizol Corporation, Wickliffe, Ohio

[21] Appl. No.: 255,834

[22] Filed: May 31, 1994

Related U.S. Application Data

[63] Continuation of Ser. No. 902,111, Jun. 22, 1992, abandoned, which is a continuation-in-part of Ser. No. 688,192, Apr. 19, 1991, abandoned.

[51] Int. Cl.[6] ..... C10M 125/00

[52] U.S. Cl. ..... 252/18; 252/25; 252/33; 252/33.2; 252/41; 252/49.6

[58] Field of Search ..... 252/18, 25, 33.2, 41

[56] References Cited

U.S. PATENT DOCUMENTS

| | | | |
|---|---|---|---|
| 2,298,660 | 10/1942 | Stevens et al. | 260/624 |
| 2,316,080 | 4/1943 | Loane et al. | 252/48 |
| 2,316,082 | 4/1943 | Loane et al. | 252/48 |
| 2,921,901 | 1/1960 | Karll et al. | 252/32.7 |
| 3,003,959 | 10/1961 | Wilson et al. | 252/32.7 |
| 3,042,613 | 7/1962 | Lemmon et al. | 252/32.7 |
| 3,127,348 | 3/1964 | Roselle | 252/32.7 |
| 3,182,019 | 5/1965 | Wilson et al. | 252/32.7 |
| 3,271,310 | 9/1966 | Lesuer | 252/35 |
| 3,312,618 | 4/1967 | Lesuer et al. | 252/33 |
| 3,377,282 | 4/1968 | Bell | 252/32.7 |
| 3,422,013 | 1/1969 | Scher | 252/33 |
| 3,562,159 | 2/1971 | Mastin | 252/32.7 |
| 3,654,152 | 4/1972 | Corringer et al. | 252/32.7 |
| 4,234,435 | 11/1980 | Meinhardt | 252/51.5 |
| 4,283,294 | 8/1981 | Clarke | 252/32.7 |
| 4,326,972 | 4/1982 | Chamberlain | 252/33.3 |
| 4,505,830 | 3/1985 | Vinci | 252/33 |
| 4,560,488 | 12/1985 | Vinci | 252/33 |
| 4,579,666 | 4/1986 | Schroeck | 252/32.7 |
| 4,744,920 | 5/1988 | Flacher et al. | 252/33.4 |
| 4,792,410 | 12/1988 | Schurna et al. | 252/38 |
| 4,867,890 | 9/1989 | Colclough et al. | 252/32.7 |
| 4,867,891 | 9/1989 | Hunt | 252/25 |
| 4,904,401 | 2/1990 | Ripple | 252/32.7 |
| 4,938,881 | 7/1990 | Ripple | 252/32.7 |
| 4,938,882 | 7/1990 | Tipon | 252/38 |
| 4,952,328 | 8/1990 | Davis et al. | 252/32.7 |
| 4,957,649 | 9/1990 | Ripple | 252/32.7 |
| 4,981,602 | 1/1991 | Ripple | 252/32.7 |

FOREIGN PATENT DOCUMENTS

| | | |
|---|---|---|
| 1055700 | 6/1979 | Canada . |
| 0212922 | 3/1987 | European Pat. Off. . |
| 0235929 | 9/1987 | European Pat. Off. . |
| 2062672 | 5/1981 | United Kingdom . |
| 8805810 | 8/1988 | WIPO . |

*Primary Examiner*—Ellen M. McAvoy
*Attorney, Agent, or Firm*—Frederick D. Hunter

[57] ABSTRACT

The invention relates to a composition, comprising: at least one basic alkali metal salt of at least one hydrocarbyl-substituted acidic organic compound, wherein the hydrocarbyl group is derived from a polyalkene having an $\overline{M}n$ of at least 600, provided that when the organic compound is a sulfonic acid, the polyalkene has an $\overline{M}n$ of at least 900; and provided that when the acidic organic compound is a mixture of acidic organic compounds containing a carboxylic acid and a sulfonic acid which has a hydrocarbyl group derived from a polyalkene having an $\overline{M}n$ of less than 900, then the carboxylic acid comprises at least 10% of the equivalents of the mixture. Methods for preparing the salts and lubricating compositions containing the salts are described.

56 Claims, No Drawings

OVERBASED ALKALI SALTS AND METHODS FOR MAKING SAME

This is a continuation of application Ser. No. 07/902,111 filed on Jun. 22, 1992 which is a continuation-in-part of application Ser. No. 07/688,192 filed on Apr. 19, 1991, now abandoned.

FIELD OF THE INVENTION

This invention relates to novel overbased alkali metal salts of sulfonic acids, carboxylic acids, phenols or mixtures thereof.

INTRODUCTION TO THE INVENTION

Alkali metal overbased metal salts of many organic acids are known compounds and are useful in numerous applications including lubricating compositions. The compounds are prepared by reacting an acidic material with a reaction mixture comprising basic metal compounds, an acidic organic compound or salt and a promoter. Generally, the acidic material is carbon dioxide and the promoters are usually lower alkyl alcohols, usually methanol, ethanol or butanol or lower alkyl acids.

In the overbasing process, the promoter improves contact between the acidic material and the basic metal compound. The result is an oil-soluble or dispersible form of the basic metal-acidic material salt, usually a metal carbonate. Procedures for making these overbased compounds are generally known.

Canadian Patent 1,055,700 relates to basic alkali sulfonate dispersions and processes. U.S. Pat. No. 4,326,972 relates to concentrates, lubricant compositions and methods for improving fuel economy of internal combustion engines. These compositions have as an essential ingredient a specific sulfurized composition and a basic alkali metal sulfonate. U.S. Pat. No. 4,904,401 relates to lubricating oil compositions. These compositions may contain a basic alkali metal salt of at least one sulfonic or carboxylic acid. U.S. Pat. No. 4,938,881 relates to lubricating oil compositions and concentrates. These compositions and concentrates include at least one basic alkali metal salt of sulfonic or carboxylic acid. U.S. Pat. No. 4,952,328 relates to lubricating oil compositions. These compositions contain from about 0.01% to about 2% by weight of at least one basic alkali metal salt of sulfonic or carboxylic acid.

It has been discovered that overbased alkali metal salts of high molecular weight acidic organic compounds may be prepared. One of the problems associated with working with high molecular weight material is effectively providing contact between the acidic material overbasing and the alkali metal compounds. Generally, previously used low molecular weight, i.e. highly volatile, materials are ineffective as promoters for high molecular weight acidic organic compounds in providing the contact necessary to produce useful overbased compounds. Furthermore, the temperature used to overbase high molecular weight acidic organic compounds generally exceeds the boiling point of highly volatile promoters.

The alkali metals salts of the promoters employed in this invention are oil soluble. Usually, the promoter itself is also oil soluble, but it is important that the metal salt of the promoter is oil soluble. Oil solubility of the promoter is an important feature of this invention because of difficulties encountered when low molecular weight promoters are employed in the process to overbase high molecular weight organic acids. The metal salts of these low molecular weight promoters are frequently oil insoluble or only sparingly soluble in oil, but are generally water soluble. If the low molecular weight promoter is not entirely lost due to volatilization, it often, because of its affinity for water, causes significant carbonation of the metal compound to take place in an aqueous phase. This presents a contact problem such that the high molecular weight organic acid reactant is effectively excluded from the process because of its limited water solubility. The result is frequently low incorporation of excess metal or products having poor oil solubility.

Thus, it is desirable that the promoter possesses desirable volatility characteristics and necessary that alkali metal salts thereof are oil-soluble.

The high molecular weight alkali metal salts are useful in many applications including lubricating applications. These compounds provide strongly basic components (alkali metal-acidic material, usually alkali metal carbonate) along with high molecular weight, solubilizing substituents.

SUMMARY OF THE INVENTION

The invention relates to a composition, comprising: at least one basic alkali metal salt of at least one hydrocarbyl-substituted acidic organic compound, wherein the hydrocarbyl group is derived from a polyalkene having an $\overline{M}n$ of at least 600, provided that when the organic compound is a sulfonic acid, the polyalkene has an $\overline{M}n$ of at least 900; and provided that when the acidic organic compound is a mixture of acidic organic compounds containing a carboxylic acid and a sulfonic acid which has a hydrocarbyl group derived from a polyalkene having an $\overline{M}n$ of less than 900, then the carboxylic acid comprises at least 10% of the equivalents of the mixture.

The invention also relates to a process for preparing basic alkali metal salts of acidic organic compounds comprising the steps of:

(A) adding at least one basic alkali metal compound to a reaction mixture comprising at least one alkali metal salt of a hydrocarbyl-substituted acidic organic composition and removing free water from the reaction mixture; and in the presence of a promoter, wherein the alkali metal salt thereof is oil soluble, (B) concurrently, thereafter (1) adding at least one basic alkali metal compound to the reaction mixture, (2) adding at least one inorganic or lower carboxylic acidic material to the reaction mixture, and (3) removing water from the reaction mixture, wherein the reaction temperature is sufficient to form an oil-soluble overbased alkali metal salt.

Preferably the promoter has a boiling point under the conditions of step (B) no less than about 30° C. below the highest temperature attained during step (B).

The overbased compositions of the present invention are useful in many applications including paints, inks, coating, ceramics processing and lubricating applications. These lubricants include crankcase lubricating oils for spark-ignited and compression-ignited internal combustion engines, including automobile and truck engines, two-cycle engines, aviation piston engines, marine and railroad diesel engines, and the like. They can also be used in gas engines, stationary power engines and turbines and the like. Automatic transmission fluids, transaxle lubricants, gear lubricants, metal-working lubricants, hydraulic fluids and other lubricating oil and grease compositions can also benefit from the incorporation therein of the compositions of the present invention.

DETAILED DESCRIPTION OF THE INVENTION

The term "hydrocarbyl" includes hydrocarbon, as well as substantially hydrocarbon, groups. Substantially hydrocarbon describes groups which contain non-hydrocarbon substituents which do not alter the predominately hydrocarbon nature of the group.

Examples of hydrocarbyl groups include the following:

(1) hydrocarbon substituents, that is, aliphatic (e.g., alkyl or alkenyl), alicyclic (e.g., cycloalkyl, cycloalkenyl) substituents, aromatic-, aliphatic- and alicyclic-substituted aromatic substituents and the like as well as cyclic substituents wherein the ring is completed through another portion of the molecule (that is, for example, any two indicated substituents may together form an alicyclic radical);

(2) substituted hydrocarbon substituents, that is, those substituents containing non-hydrocarbon groups which, in the context of this invention, do not alter the predominantly hydrocarbon substituent; those skilled in the art will be aware of such groups (e.g., halo (especially chloro and fluoro), hydroxy, alkoxy, mercapto, alkylmercapto, nitro, nitroso, sulfoxy, etc.);

(3) hetero substituents, that is, substituents which will, while having a predominantly hydrocarbon character within the context of this invention, contain other than carbon present in a ring or chain otherwise composed of carbon atoms. Suitable heteroatoms will be apparent to those of ordinary skill in the art and include, for example, sulfur, oxygen, nitrogen and such substituents as, e.g., pyridyl, furyl, thienyl, imidazolyl, etc. In general, no more than about 2, preferably no more than one, non-hydrocarbon substituent will be present for every ten carbon atoms in the hydrocarbyl group. Typically, there will be no such non-hydrocarbon substituents in the hydrocarbyl group. Therefore, the hydrocarbyl group is purely hydrocarbon.

The present lubricating compositions contain an alkali metal basic salt of a carboxylic acid, sulfonic acid, phosphorus acid or a phenol. These basic salts are often referred to as overbased salts. The overbased salts are single phase, homogeneous Newtonian systems characterized by a metal content in excess of that which would be present according to the stoichiometry of the metal and the particular organic compound reacted with the metal. The amount of excess metal is commonly expressed in metal ratio. The term "metal ratio" is the ratio of the total equivalents of the metal to the equivalents of the acidic organic compound. A neutral metal salt has a metal ratio of one. A salt having 4.5 times as much metal as present in a normal salt will have metal excess of 3.5 equivalents, or a ratio of 4.5. In the present invention, these salts preferably have a metal ratio from about 1.5 to about 40, preferably about 3 to about 30, more preferably about 3 to about 25.

In a particularly preferred embodiment, the overbased salts have metal ratios of at least about 4, often at least about 5. Frequently, the metal ratio is at least about 9. Metal ratios up to about 30, often up to about 25, are particular preferred.

The overbased materials are prepared by reacting an acidic material, typically carbon dioxide, with a mixture comprising a carboxylic acid, a sulfonic acid, phosphorus acid or a phenol, a reaction medium comprising at least one inert, organic solvent for said organic material, a stoichiometric excess of the above-described metal compound, and a promoter. Preferably, the overbased materials are prepared with carboxylic acids or sulfonic acids. The carboxylic and sulfonic acids may have substituent groups derived from the polyalkenes. The polyalkene is characterized as containing from at least about 45, preferably at least about 50, more preferably about 60, up to about 300 carbon atoms, generally about 200, preferably about 100, more preferably about 80. In one embodiment, the polyalkene is characterized by an $\overline{M}n$ (number average molecular weight) value of at least about 600. Generally, the polyalkene is characterized by an $\overline{M}n$ value of about 600, preferably about 700, more preferably about 800, still more preferably about 900 up to about 5000, preferably 2500, more preferably 2000, still more preferably about 1500. In another embodiment $\overline{M}n$ varies between about 600, preferably about 700, more preferably about 800 to about 200 or 1300.

The abbreviation $\overline{M}n$ is the conventional symbol representing number average molecular weight. Gel permeation chromatography (GPC) is a method which provides both weight average and number average molecular weights as well as the entire molecular weight distribution of the polymers. For purpose of this invention a series of fractionated polymers of isobutene, polyisobutene, is used as the calibration standard in the GPC.

The techniques for determining $\overline{M}n$ and $\overline{M}w$ values of polymers are well known and are described in numerous books and articles. For example, methods for the determination of $\overline{M}n$ and molecular weight distribution of polymers is described in W. W. Yah, J. J. Kirkland and D. D. Bly, "Modern Size Exclusion Liquid Chromatographs", J. Wiley & Sons, Inc., 1979.

The polyalkenes include homopolymers and interpolymers of polymerizable olefin monomers of 2 to about 16 carbon atoms; usually 2 to about 6, preferably 2 to about 4, more preferably 4. The olefins may be monoolefins such as ethylene, propylene, 1-butshe, isobutene, and 1-octene; or a polyolefinic monomer, preferably diolefinic monomer, such as 1,3-butadiene and isoprene. The polyalkenes are prepared by conventional procedures.

Suitable carboxylic acids from which useful alkali metal salts can be prepared include aliphatic, cycloaliphatic and aromatic mono- and polybasic carboxylic acids free from acetylenic unsaturation, including naphthenic acids, alkyl- or alkenyl-substituted cyclopentanoic acids, alkyl- or alkenyl-substituted succinic acids or anhydrides, alkyl- or alkenyl-substituted cyclohexanoic acids, and alkyl- or alkenyl-substituted aromatic carboxylic acids. The acids are generally prepared by reacting an unsaturated acid or derivative thereof with one of the above-described polyalkenes or derivative thereof. Generally, the unsaturated acid is an alpha, beta unsaturated carboxylic acid. Examples of these acids include maleic, itaconic, citraconic, glutaric, crotonic, acrylic, and methacrylic acids or derivatives thereof. The derivatives of the unsaturated carboxylic acid include acids, anhydrides, metal or amine salts, lower alkyl esters ($C_{1-7}$ alkyl esters), and the like.

Illustrative carboxylic acids include propylenylsubstituted glutaric acid, polybutenyl-substituted succinic acids derived from a polybutene ($\overline{M}n$ equals about 200–1,500, preferably about 300–1500), propenyl-substituted succinic acids derived from polypropylenes ($\overline{M}n$ equal 200–1000), acids, acids formed by oxidation of petrolatum or of hydrocarbon waxes, available mixtures of two or more carboxylic acids and mixtures of these acids, their metal salts, and/or their anhydrides.

In one embodiment, the carboxylic acids are aromatic carboxylic acids. A group of useful aromatic carboxylic acids are those of the formula

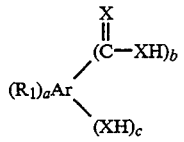

wherein $R_1$ is an aliphatic hydrocarbyl group preferably derived from the above-described polyalkenes, a is a number in the range of 1 to about 4, usually 1 or 2, Ar is an aromatic group, each X is independently sulfur or oxygen, preferably oxygen, b is a number in the range of from 1 to about 4, usually 1 or 2, c is a number in the range of zero to about 4, usually 1 to 2, with the proviso that the sum of a, b and c does not exceed the number of valences of Ar. Examples of aromatic carboxylic acids include substituted benzoic, phthalic and salicylic acids.

The $R_1$ group is a hydrocarbyl group that is directly bonded to the aromatic group Ar. Examples of $R_1$ groups include substituents derived from polymerized olefins such as polyethylenes, polypropylenes, polybutylenes, ethylene-propylene copolymers, chlorinated olefin polymers and oxidized ethylene-propylene copolymers.

The aromatic group Ar may have the same structure as any of the aromatic groups Ar discussed below. Examples of the aromatic groups that are useful herein include the polyvalent aromatic groups derived from benzene, naphthalene, anthracene, etc., preferably benzene. Specific examples of Ar groups include phenylenes and naphthylene, e.g., methylphenylenes, ethoxyphenylenes, isopropylphenylenes, hydroxyphenylenes, dipropoxynaphthylenes, etc.

Within this group of aromatic acids, a useful class of carboxylic acids are those of the formula

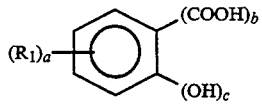

wherein $R_1$ is defined above, a is a number in the range of from 1 to about 4, preferably 1 to about 3; b is a number in the range of 1 to about 4, preferably 1 to about 2, c is a number in the range of zero to about 4, preferably 1 to about 2, and more preferably 1; with the proviso that the sum of a, b and c does not exceed 6. Preferably, b and c are each one and the carboxylic acid is a salicylic acid.

Overbased salts prepared from salicylic acids wherein the aliphatic hydrocarbon substituents ($R_1$) are derived from the above-described polyalkenes, particularly polymerized lower 1-mono-olefins such as polyethylene, polypropylene, polyisobutylene, ethylene/-propylene copolymers and the like and having average carbon contents of about 50 to about 400 carbon atoms are particularly useful.

The above aromatic carboxylic acids are well known or can be prepared according to procedures known in the art. Carboxylic acids of the type illustrated by these formulae and processes for preparing their neutral and basic metal salts are well known and disclosed, for example, in U.S. Pat. Nos. 2,197,832; 2,197,835; 2,252,662; 2,252,664; 2,714,092; 3,410,798; and 3,595,791. These references are incorporated by reference for disclosure of carboxylic acid, their basic salt and processes of making the same.

The sulfonic acids useful in making the overbased salts (A) of the invention include the sulfonic and thiosulfonic acids. Generally they are salts of sulfonic acids. The sulfonic acids include the mono- or polynuclear aromatic or cycloaliphatic compounds. The oil-soluble sulfonic acids can be represented for the most part by one of the following formulae: $R_2$-T-$(SO_3)_aH$ and $R_3$-$(SO_3)_bH$, wherein T is a cyclic nucleus such as, for example, benzene, naphthalene, anthracene, diphenylene oxide, diphenylene sulfide, petroleum naphthenes, etc. Specific examples of $R_2$ and $R_3$ are groups derived from petrolatum, saturated and unsaturated paraffin wax, and the above-described polyalkenes. The groups T, $R_2$, and $R_3$ in the above Formulae can also contain other inorganic or organic substituents in addition to those enumerated above such as, for example, hydroxy, mercapto, halogen, nitro, amino, nitroso, sulfide, disulfide, etc. In the above Formulae, a and b are at least 1.

Illustrative examples of these sulfonic acids include polybutene or polypropylene substituted naphthalene sulfonic acids, sulfonic acids derived by the treatment of polybutenes having a number average molecular weight ($\overline{M}n$) in the range of 700 to 5000, preferably 700 to 1200, more preferably about 1500 with chlorosulfonic acids, paraffin wax sulfonic acids, polyethylene ($\overline{M}n$ equals about 900–2000, preferably about 900–1500, more preferably 900–1200 or 1300) sulfonic acids, etc. Preferred sulfonic acids are mono-, di-, and tri-alkylated benzene (including hydrogenated forms thereof) sulfonic acids.

In another embodiment, the hydrocarbyl-substituted acidic organic compound is a phenol. The phenol may be a coupled or uncoupled phenol, preferably a substituted phenol. The phenols may be alkylene coupled, wherein the alkylene- group contains from 1 to about 8 carbon atoms, preferably 1 to about 4 carbon atoms, more preferably 1 carbon atom. Alkylene coupled phenols are prepared by procedures known to those in the art. Generally, the phenol is reacted with an aldehyde, usually formaldehyde or a formaldehyde precursor such as paraformaldehyde, at a temperature from about 50° C. to about 175° C. A diluent may be used such as mineral oil, naphtha, kerosene, toluene or xylene.

The phenol may be a sulfur-coupled phenol which is prepared by reacting a sulfurizing agent with the phenol. The sulfurizing agent generally is elemental sulfur or a sulfur halide, such as sulfur monochloride or sulfur dichloride, preferably sulfur dichloride. Sulfur coupled phenols, also referred to as polyphenol sulfides, are generally prepared by reacting a sulfur halide with a phenol at a temperature from about 50° C. to about 75° C. The diluent as described above may also be used.

In a preferred embodiment, the phenol is substituted with one of the polyalkene groups described above. Preferably, the phenol has a polybutene or polypropylene substituent having a number average molecular weight of about 700 to about 1200 or 1300.

The phenols useful in making the overbased salts of the invention can be represented by the formula $(R_1)_a$-$Ar(OH)_b$, wherein $R_1$ is defined above; Ar is an aromatic group; a and b are independently numbers of at least one, the sum of a and b being in the range of two up to the number of displaceable hydrogens on the aromatic nucleus or nuclei of Ar. Preferably, a and b are independently numbers in the range of 1 to about 4, more preferably 1 to about 2. $R_1$ and a are preferably such that there is an average of at least about 8 aliphatic carbon atoms provided by the $R_1$ groups for each phenol compound.

While the term "phenol" is used herein, it is to be understood that this term is not intended to limit the aromatic group of the phenol to benzene. Accordingly, it is to be understood that the aromatic group as represented by "Ar" as well as elsewhere in other formulae in this specification and in the appended claims, can be mononuclear such as a phenyl, a pyridyl, or a thienyl, or polynuclear. The polynuclear groups can be of the fused type wherein an aromatic nucleus is fused at two points to another nucleus such as found in naphthyl, anthranyl, etc. The polynuclear group can also be of the linked type wherein at least two nuclei (either mononuclear or polynuclear) are linked through bridging linkages to each other. These bridging linkages can be chosen from the group consisting of alkylene linkages, ether linkages, keto linkages, sulfide linkages, polysulfide linkages of 2 to about 6 sulfur atoms, etc.

The number of aromatic nuclei, fused, linked or both, in Ar can play a role in determining the integer values of a and b. For example, when Ar contains a single aromatic nucleus, the sum of a and b is from 2 to 6. When Ar contains two aromatic nuclei, the sum of a and b is from 2 to 10. With a tri-nuclear Ar moiety, the sum of a and b is from 2 to 15. The value for the sum of a and b is limited by the fact that it cannot exceed the total number of displaceable hydrogens on the aromatic nucleus or nuclei of Ar.

The promoters, that is, these materials which facilitate the incorporation of excess metal into the overbased material, act to improve contact between the acidic material and the acidic organic compound (overbasing substrate).

As discussed hereinabove, in order to maintain contact during the reaction of the high molecular weight organic acid, the promoter salt and inorganic or lower carboxylic acidic material, it is important that the alkali metal salt of the promoter is oil soluble. By oil soluble is meant that the alkali metal salt of the promoter is soluble in oil to the extent of at least 1%, preferably at least 10%, more preferably at least 50%, by weight.

In order to avoid loss of the promoter from volatilization, it is desirable that the promoter have a boiling point sufficiently high such that significant amounts thereof are not lost due to volatilization under the reaction conditions. Preferably the promoter has a boiling point no less than 30° C. below the highest temperature encountered during the reaction, more preferably no less than 10° C. below. More preferably, the boiling point of the promoter is no less than the highest reaction temperature encountered. Generally, the promoter is a material which is slightly acidic and able to form a salt with the basic metal compound. The promoter must also be an acid weak enough to be displaced by the acidic material, usually carbon dioxide. Generally, the promoter has a pKa in the range from about 7 to about 10. A particularly comprehensive discussion of suitable promoters is found in U.S. Pat. No. 2,777,874; 2,695,910; 2,616,904; 3,384,586; and 3,492,231. These patents are incorporated by reference for their disclosure of promoters. In one embodiment, promoters include the phenolic promoters. Phenolic promoters include a variety of hydroxy-substituted benzenes and naphthalenes. A particularly useful class of phenols are the alkylated phenols of the type listed in U.S. Pat. No. 2,777,874, e.g., heptylphenols, octylphenols, and nonylphenols. Mixtures of various promoters are sometimes used.

The inorganic or lower carboxylic acidic materials, which are reacted with the mixture of promoter, basic metal compound, reaction medium and acidic organic compound, are disclosed in the above cited patents, for example, U.S. Pat. No. 2,616,904. Included within the known group of useful acidic materials are lower carboxylic acids, having from 1 to about 8, preferably 1 to about 4 carbon atoms. Examples of these acids include formic acid, acetic acid, propanoic acid, etc., preferably acetic acid. Useful inorganic acidic compounds include HCl, $SO_2$, $SO_3$, $CO_2$, $H_2S$, $N_2O_3$, etc., are ordinarily employed as the acidic materials. Preferred acidic materials are carbon dioxide and acetic acid, more preferably carbon dioxide.

The alkali metals present in the overbased alkali metal salts include principally lithium, sodium and potassium, with sodium being preferred. The overbased metal salts are prepared using a basic alkali metal compound. Illustrative of basic alkali metal compounds are hydroxides, oxides, alkoxides (typically those in which the alkoxy group contains up to 10 and preferably up to 7 carbon atoms), hydrides and amides of alkali metals. Thus, useful basic alkali metal compounds include sodium oxide, potassium oxide, lithium oxide, sodium hydroxide, potassium hydroxide, lithium hydroxide, sodium propoxide, lithium methoxide, potassium ethoxide, sodium butoxide, lithium hydride, sodium hydride, potassium hydride, lithium amide, sodium amide and potassium amide. Especially preferred are sodium hydroxide and the sodium lower alkoxides (i.e., those containing up to 7 carbon atoms).

The overbased materials of the present invention may be prepared by methods known to those in the art. The methods generally involve adding acidic material to a reaction mixture comprising the hydrocarbyl-substituted acidic organic compound, the promoter and a basic alkali metal compound. These processes are described in the following U.S. Pat. Nos.: 2,616,904; 2,616,905; 2,616,906; 3,242,080; 3,250,710; 3,256,186; 3,274,135; 3,492,231; and 4,230,586. These patents are incorporated herein by reference for these disclosures.

In the present invention, the hydrocarbyl-substituted acidic organic materials have relatively high molecular weights. Higher temperatures are generally used to promote contact between the acidic material, the acidic organic compound and the basic alkali metal compound. The higher temperatures also promote formation of the salt of the weakly acidic promoter by removal of water. As noted hereinabove, these higher reaction temperatures require that the promoter has sufficiently low volatility to avoid loss of significant amounts thereof from the reaction mixture. In preparing the overbased metal salts of the present invention, water must be removed from the reaction.

The reaction generally proceeds at temperatures from about 100° C. up to the decomposition temperature of the reaction mixture or the individual components of the reaction. The reaction may proceed at temperatures lower than 100° C., such as 60° C. or above, if a vacuum is applied. Generally, the reaction occurs at a temperature from about 110° C. to about 200° C., preferably 120° C. to about 175° C. and more preferably about 130° C. to about 150° C. Preferably, the reaction is performed in the presence of a reaction medium which includes naphtha, mineral oil, xylenes, toluenes and the like. In the present invention water may be removed by applying a vacuum, by blowing the reaction mixture with a gas such as nitrogen or by removing water as an azeotrope, such as a xylene-water azeotrope. Generally, in the present invention, the acidic material is provided as a gas, usually carbon dioxide. The carbon dioxide, while participating in the overbasing process, also acts to remove water if the carbon dioxide is added at a rate which exceeds the rate carbon dioxide is consumed in the reaction.

The overbased metal salts of the present invention may be prepared incrementally (batch) or by continuous process. The incremental process involves the following steps: (A) adding a basic alkali metal compound to a reaction mixture comprising an acidic organic compound and removing free water from the reaction mixture to form an alkali metal salt of the acidic organic compound; (B) adding the basic alkali metal compound to the reaction mixture and removing free water from the reaction mixture; and in the presence of a promoter, (C) introducing the acidic material to the reaction mixture while removing water. Steps (B) and (C) are repeated until a product of the desired metal ratio is obtained.

A novel aspect of the present invention is the semicontinuous process for preparing the alkali metal overbased salts of the present invention. The process involves (A) adding at least one basic alkali metal compound to a reaction mixture comprising an alkali metal salt of an acidic organic compound and removing free water from the reaction mixture; and in the presence of a promoter as described hereinabove, (B) concurrently thereafter, (1) adding basic alkali metal compound to the reaction mixture; (2) adding an inorganic or lower carboxylic acidic material to the reaction mixture; and (3) removing water from the reaction mixture. The inventors have discovered that the addition of basic alkali metal compounds together with the inorganic or lower carboxylic acidic material may be accomplished by a process where the addition is done continuously along with the removal of water. This process shortens processing time of the reaction.

The term "free water" refers to the amount of water readily removed from the reaction mixture. This water is typically removed by azeotropic distillation. The water which remains in the reaction mixture is believed to be coordinated, associated, or solvated. The water may be in the form of water of hydration. Some basic alkali metal compounds may be delivered to the reaction mixture as aqueous solutions. The excess water added, or free water, with the basic alkali metal compound is usually then removed by azeotropic distillation, or vacuum stripping.

Water is generated during the overbasing process and is desirably removed as it is formed to minimize or eliminate formation of oil-insoluble metal carbonates. During the overbasing process above, the amount of water present prior to addition of the inorganic or lower carboxylic acidic material (steps (C) and (B-1) above) is less than about 30% by weight of the reaction mixture, preferably 20%, more preferably 10%. Generally, the amount of water present after addition of the inorganic or lower carboxylic acidic material is up to about 4% by weight of the reaction mixture, preferably about 3%, more preferably about 2%.

When the process involves concurrent addition of basic alkali metal compounds and inorganic or lower carboxylic acidic materials, the hydrocarbyl group of the acidic organic compound is derived from the above-described polyalkenes. The provisos related to the polyalkene of the sulfonic acid and mixture of acidic organic compound are only preferred embodiments.

In another embodiment, the alkali metal overbased salts are borated alkali metal overbased salts. Borated overbased metal salts are prepared by reacting a boron compound with the basic alkali metal salt. Boron compounds include boron oxide, boron oxide hydrate, boron trioxide, boron trifluoride, boron tribromide, boron trichloride, boron acid such as boronic acid, boric acid, tetraboric acid and metaboric acid, boron hydrides, boron amides and various esters of boron acids. The boron esters are preferably lower alkyl (1–7 carbon atoms) esters of boric acid. Preferably, the boron compounds are boric acid. Generally, the overbased metal salt is reacted with a boron compound at about 50° C. to about 250° C., preferably 100° C. to about 200° C. The reaction may be accomplished in the presence of a solvent such as mineral oil, naphtha, kerosene, toluene or xylene. The overbased metal salt is reacted with a boron compound in amounts to provide at least about 0.5%, preferably about 1% up to about 5%, preferably about 4%, more preferably about 3% by weight boron to the composition.

The following examples illustrate the alkali metal overbased salts of the present invention and methods of making the same. In the examples and elsewhere in the specification, unless otherwise indicated, the temperature is degrees Celsius, the amounts are weight percent, and the pressure is atmospheric.

EXAMPLE 1

A reaction vessel is charged with 1122 parts (2 equivalents) of a polybutenyl-substituted succinic anhydride derived from a polybutene ($\overline{M}n=1000$), 105 parts (0.4 equivalent) of tetrapropenyl phenol, 1122 parts of xylene and 1000 grams of 100 neutral mineral oil. The mixture is stirred and heated to 80° C. under nitrogen. Then, 580 parts of a 50% aqueous solution of sodium hydroxide is added to the vessel over 10 minutes. The mixture is heated from 80° C. to 120° C. over 1.3 hours. Water is removed by azeotropic reflux and the temperature rises to 150° C. over 6 hours while water is collected. (1) The reaction mixture is cooled to 80° C. where 540 parts of a 50% aqueous solution of sodium hydroxide is added to the vessel. (2) The reaction mixture is heated to 140° C. over 1.7 hours and water is removed at reflux conditions. (3) The reaction mixture is carbonated at 1 standard cubic foot per hour (scfh) while removing water for 5 hours. Steps (1)–(3) are repeated using 560 parts of an aqueous sodium hydroxide solution. Steps (1)–(3) are repeated using 640 parts of an aqueous sodium hydroxide solution. Steps (1)–(3) are then repeated with another 580 parts of a 50% aqueous sodium hydroxide solution. The reaction mixture is cooled and 1000 parts of 100 neutral mineral oil are added to the reaction mixture. The reaction mixture is vacuum stripped to 115° C., about 30 millimeters of mercury. The residue is filtered through diatomaceous earth.

EXAMPLE 2

A reaction vessel is charged with 700 parts of a 100 neutral mineral oil, 700 parts (1.25 equivalents) of the succinic anhydride of Example 1 and 200 parts (2.5 equivalents) of a 50% aqueous solution of sodium hydroxide. The reaction mixture is stirred and heated to 80° C. where 66 parts (0.25 equivalent) of tetrapropenyl phenol are added to the reaction vessel. The reaction mixture is heated from 80° C. to 140° C. over 2.5 hours with blowing of nitrogen and removal of 40 parts of water. Carbon dioxide (28 parts, 1.25 equivalents) is added over 2.25 hours at a temperature from 140°–165° C. The reaction mixture is blown with nitrogen at 2 standard cubic foot per hour (scfh) and a total of 112 parts of water is removed. The reaction temperature is decreased to 115° C. and the reaction mixture is filtered through diatomaceous earth. The filtrate has 4.06% sodium (theoretical 3.66), a total base number of 89, a specific gravity of 0.948 and 44.5% oil.

EXAMPLE 3

A reaction vessel is charged with 281 parts (0.5 equivalent) of the succinic anhydride of Example 1, 281 parts of xylene, 26 parts of tetrapropenyl substituted phenol and 250 parts of 100 neutral mineral oil. The mixture is heated to 80° C. and 272 parts (3.4 equivalents) of an aqueous sodium hydroxide solution are added to the reaction mixture. The mixture is blown with nitrogen at 1 scfh and the reaction temperature is increased to 148° C. The reaction mixture is then blown with carbon dioxide at 1 scfh for one hour and 25 minutes while 150 parts of water is collected. The reaction mixture is cooled to 80° C. where 272 parts (3.4 equivalents) of the above sodium hydroxide solution is added to the reaction mixture and the mixture is blown with nitrogen at 1 scfh. The reaction temperature is increased to 140° C. where the reaction mixture is blown with carbon dioxide at 1 scfh for 1 hour and 25 minutes while 150 parts of water is collected. The reaction temperature is decreased to 100° C. and 272 parts (3.4 equivalents) of the above sodium hydroxide solution is added while blowing the mixture with nitrogen at i scfh. The reaction temperature is increased to 148° C. and the reaction mixture is blown with carbon dioxide at 1 scfh for 1 hour and 40 minutes while 160 parts of water is collected. The reaction mixture is cooled to 90° C. and where 250 parts of 100 neutral mineral oil are added to the reaction mixture. The reaction mixture is vacuum stripped at 70° C. and the residue is filtered through diatomaceous earth.

The filtrate contains 50.0% sodium sulfate ash (theoretical 53.8%) by ASTM D-874, total base number of 408, a specific gravity of 1.18 and 37.1% oil.

EXAMPLE 4

A reaction vessel is charged with 700 parts of the product of Example 3. The .reaction mixture is heated to 75° C. where 340 parts (5.5 equivalents) of boric acid is added over 30 minutes. The reaction mixture is heated to 110° C. over 45 minutes and the reaction temperature is maintained for 2 hours. A 100 neutral mineral oil (80 parts) is added to the reaction mixture. The reaction mixture is blown with nitrogen at 1 scfh at 160° C. for 30 minutes while 95 parts of water is collected. Xylene (200 parts) is added to the reaction mixture and the reaction temperature is maintained at 130°–140° C. for 3 hours. The reaction mixture is vacuum stripped at 150° C. and 20 millimeters of mercury. The residue is filtered through diatomaceous earth. The filtrate contains 5.84% boron (theoretical 6.43) and 33.1% oil. The residue has a total base number of 309.

EXAMPLE 5

A reaction vessel is charged with 224 parts (0.4 equivalents) of the succinic anhydride of Example 1, 21 parts (0.08 equivalent) of a tetrapropenyl phenol, 224 parts of xylene and 224 parts of 100 neutral mineral oil. The mixture is heated and 212 parts (2.65 equivalents) of a 50% aqueous sodium hydroxide solution are added to the reaction vessel. The reaction temperature increases to 130° C. and 41 parts of water is removed by nitrogen blowing at 1 scfh. The reaction mixture is then blown with carbon dioxide at 1 scfh for 1.25 hours. The sodium hydroxide solution (432 parts, 5.4 equivalents) is added over four hours with carbon dioxide blowing at 0.5 scfh at 130° C. During the addition, 301 parts of water are removed from the reaction vessel. The reaction temperature is increased to 150° C. and the rate of carbon dioxide blowing is increased to 1.5 scfh and maintained for 1 hour and 15 minutes. The reaction mixture is cooled to 150° C. and blown with nitrogen at 1 scfh while 176 parts of oil is added to the reaction mixture. The reaction mixture is blown with nitrogen at 1.8 scfh for 2.5 hours and the mixture is then filtered through diatomaceous earth. The filtrate contains 15.7% sodium and 39% oil. The filtrate has a total base number of 380.

EXAMPLE 6

A reaction vessel is charged with 561 parts (1 equivalent) of the succinic anhydride of Example 1, 52.5 parts (0.2 equivalent) of a tetrapropenylphenol, 561 parts xylene and 500 parts of a 100 neutral mineral oil. The mixture is heated to 50° C. under nitrogen and 373.8 parts (6.8 equivalents) of potassium hydroxide and 299 parts of water are added to the mixture. The reaction mixture is heated to 135° C. while 145 parts of water is removed. The azeotropic distillate is clear. Carbon dioxide is added to the reaction mixture at 1 scfh for two hours while 195 parts of water is removed azeotropically. The reaction is cooled to 75° C. where a second portion of 373.8 parts of potassium hydroxide and 150 parts of water are added to the reaction vessel. The reaction mixture is heated to 150° C. with azeotropic removal of 70 parts of water. Carbon dioxide (1 scfh) is added for 2.5 hours while 115 parts of water is removed azeotropically. The reaction is cooled to 100° C. where a third portion of 373.8 parts of potassium hydroxide and 150 parts of water is added to the vessel. The reaction mixture is heated to 150° C. while 70 parts of water is removed. The reaction mixture is blown with carbon dioxide at 1 scfh for one hour while 30 parts of water is removed. The reaction temperature is decreased to 70° C. The reaction mixture is reheated to 150° C. under nitrogen. At 150° C. the reaction mixture is blown with carbon dioxide at 1 scfh for two hours while 80 parts of water is removed. The carbon dioxide is replaced with a nitrogen purge and 60 parts of water is removed. The reaction is then blown with carbon dioxide at 1 scfh for three hours with removal of 64 parts of water. The reaction mixture is cooled to 75° C. where 500 parts of 100 neutral mineral is added to the reaction mixture. The reaction is vacuum stripped to 115° C. and 25 millimeters of mercury. The residue is filtered through diatomaceous earth. The filtrate contains 35% oil and has a base number of 322.

EXAMPLE 7

An overbased sodium salt of a substituted phenol is prepared by the process of Example 1 using 994 parts (1 equivalent) of polybutenyl-substituted phenol derived from a polybutene ($\overline{M}n=900$) reacted with 1440 (18 equivalents) of a 50% aqueous solution of sodium hydroxide.

EXAMPLE 8

An overbased sodium sulfonate is prepared by the process described in Example 6 by using 980 parts (1 equivalent) of a sodium polypropenyl-substituted benzene sulfonate derived from a polypropene ($\overline{M}n=800$) and 800 parts (10 equivalents) of a 50% aqueous solution of sodium hydroxide.

EXAMPLE 9

An overbased lithium carboxylate is prepared by the process described in Example 1 using 1072 parts (1 equivalent) of a polybutenyl of carboxylate, prepared by reacting polybutenyl chloride derived from a polybutene ($\overline{M}n=1000$) and acrylic acid, which is reacted with 756 parts (18 equivalents) of lithium hydroxide monohydrate.

EXAMPLE 10

An overbased sodium sulfonate-carboxylate is prepared by the process described in Example 1 using 562 parts of the succinic anhydride of Example 1 and 479 parts of a polybutenyl-substituted sulfonic acid derived from a polybutene ($\overline{M}n=800$) and 1632 parts (20.4 equivalents) of a 50% aqueous solution of sodium hydroxide.

Lubricating Compositions

The alkali metal overbased salts of the present invention may be used, in lubricants or in concentrates, by themselves or in combination with any other known additive which includes, but is not limited to dispersants, detergents, antioxidants, anti-wear agents, extreme pressure agents, emulsifiers, demulsifiers, foam inhibitors, friction modifiers, anti-rust agents, corrosion inhibitors, viscosity improvers, pour point depressants, dyes, and solvents to improve handleability which may include alkyl and/or aryl hydrocarbons. These additives may be present in various amounts depending on the needs of the final product.

Dispersants include, but are not limited to, hydrocarbon substituted succinimides, succinamides, carboxylic esters, Mannich dispersants and mixtures thereof as well as materials functioning both as dispersants and viscosity improvers. The dispersants include nitrogen-containing carboxylic dispersants, ester dispersants, Mannich dispersants or mixtures thereof. Nitrogen-containing carboxylic dispersants are prepared by reacting a hydrocarbyl carboxylic acylating agent (usually a hydrocarbyl substituted succinic anhydride) with an amine (usually a polyamine). Ester dispersants are prepared by reacting a polyhydroxy compound with a hydrocarbyl carboxylic acylating agent. The ester dispersant may be further treated with an amine. Mannich dispersants are prepared by reacting a hydroxy aromatic compound with an amine and aldehyde. The dispersants listed above may be post-treated with reagents such as urea, thiourea, carbon disulfide, aldehydes, ketones, carboxylic acids, hydrocarbon substituted succinic anhydride, nitriles, epoxides, boron compounds, phosphorus compounds and the like.

Detergents include, but are not limited to, Newtonian or non-Newtonian, neutral or basic salts of alkaline earth or transition metals with one or more hydrocarbyl sulfonic acid, carboxylic acid, phosphoric acid, thiophosphoric acid, dithiophosphoric acid, phosphinic acid, thiophosphinic acid, sulfur coupled phenol or phenol. Basic salts are salts that contain a stoichiometric excess of metal present per acid function.

Auxiliary extreme pressure agents and corrosion- and oxidation-inhibiting agents which may be included in the lubricants of the invention are exemplified by chlorinated aliphatic hydrocarbons such as chlorinated wax; organic sulfides and polysulfides such as benzyl disulfide, bis(chlorobenzyl)disulfide, dibutyl tetrasulfide, sulfurized methyl ester of oleic acid, sulfurized alkylphenol, sulfurized dipentene, and sulfurized terpene; phosphosulfurized hydrocarbons such as the reaction product of a phosphorus sulfide with turpentine or methyl oleate, phosphorus esters including principally dihydrocarbon and trihydrocarbon phosphites such as dibutyl phosphite, diheptyl phosphite, dicyclohexyl phosphite, pentylphenyl phosphite, dipentylphenyl phosphite, tridecyl phosphite, distearyl phosphite, dimethyl naphthyl phosphite, oleyl 4-pentylphenyl phosphite, polypropylene (molecular weight 500)-substituted phenyl phosphite, diisobutyl-substituted phenyl phosphite; metal thiocarbamates, such as zinc dioctyldithiocarbamate, and barium heptylphenyl dithiocarbamate; boron-containing compounds including borate esters; molybdenum compounds; Group II metal phosphorodithioates such as zinc dicyclohexylphosphorodithioate, zinc dioctylphosphorodithioate, barium di(heptylphenyl)-phosphorodithioate, cadmium dinonylphosphorodithioate, and the zinc salt of a phosphorodithioic acid produced by the reaction of phosphorus pentasulfide with an equimolar mixture of isopropyl alcohol and n-hexyl alcohol.

Viscosity improvers include, but are not limited to, polyisobutenes, polymethacrylate acid esters, polyacrylate acid esters, diene polymers, polyalkyl styrenes, alkenyl aryl conjugated diene copolymers, polyolefins and multifunctional viscosity improvers.

Pour point depressants are a particularly useful type of additive often included in the lubricating oils described herein. See for example, page 8 of "Lubricant Additives" by C. V. Smalheer and R. Kennedy Smith (Lesius-Hiles Company Publishers, Cleveland, Ohio, 1967).

Anti-foam agents used to reduce or prevent the formation of stable foam include silicones or organic polymers. Examples of these and additional anti-foam compositions are described in "Foam Control Agents", by Henry T. Kerner (Noyes Data Corporation, 1976), pages 125–162.

These and other additives are described in greater detail in U.S. Pat. No. 4,582,618 (column 14, line 52 through column 17, line 16, inclusive), herein incorporated by reference for its disclosure of other additives that may be used in combination with the present invention.

The concentrate might contain 0.01 to 90% by weight of the alkali metal overbased salts. The alkali metal overbased salts may be present in a final product, blend or concentrate in (in a minor amount, i.e., up to 50% by weight) any amount effective to act as a detergent, but is preferably present in oil of lubricating viscosity, hydraulic oils, fuel oils, gear oils or automatic transmission fluids in an amount of from about 0.1 to about 10%, preferably 0.25 to about 2% by weight, most preferably about 0.50 to about 1.25%.

The lubricating compositions and methods of this invention employ an oil of lubricating viscosity, including natural or synthetic lubricating oils and mixtures thereof. Natural oils include animal oils, vegetable oils, mineral lubricating oils, solvent or acid treated mineral oils, and oils derived from coal or shale. Synthetic lubricating oils include hydrocarbon oils, halo-substituted hydrocarbon oils, alkylene oxide polymers, esters of carboxylic acids and polyols, esters of polycarboxylic acids and alcohols, esters of phosphorus-containing acids, polymeric tetrahydrofurans, silicon-based oils and mixtures thereof.

Specific examples of the oils of lubricating viscosity are described in U.S. Pat. No. 4,326,972 and European Patent Publication 107,282, both herein incorporated by reference for their disclosures relating to lubricating oils. A basic, brief description of lubricant base oils appears in an article by D. V,. Drock, "Lubricant Base Cells" *Lubrication Engineering,* volume 43, pages 184–185, March, 1987. This article is herein incorporated by reference for its disclosures relating to lubricating oils. A description of oils of lubricating viscosity occurs in U.S. Pat. No. 4,582,618 (column 2, line 37 through column 3, line 63, inclusive), herein incorporated by reference for its disclosure to oils of lubricating viscosity.

The following examples illustrate lubricating compositions of the present invention. The amount of each component in Examples A-C reflects the amount of oil containing product of the indicated additives.

| | Lubricant (% weight) | | |
|---|---|---|---|
| Component | A | B | C |
| Product of Example 1 | 0.76 | 1.04 | 1.04 |
| Reaction product of polybutene succinic anhydride (Polybutene $\overline{Mn}$ = 1845) and ethylene polyamines | 5.7 | 6.25 | 6.25 |
| Zinc-isopropyl,methylamyl dithiophosphate | 0.9 | 1.12 | 1.12 |
| Methylene-bis(6-t-butyl-4-tetrapropenyl phenol) | 0.33 | 0.32 | — |
| 2,6-di-t-butyl-4-tetrapropenyl phenol | — | — | 0.37 |
| Copper-O,O'isopropyl, methylamyl dithiophosphate | 0.08 | 0.1 | 0.1 |
| Glycerolmonooleate or oleylamide | 0.1 | 0.1 | 0.1 |
| 8% by weight hydrogenated styrene-butadiene copolymer in 100 neutral mineral oil | 9.5 | 9.0 | 10.0 |
| Silicon antifoam agent | 80 ppm | 80 ppm | 80 ppm |
| Oil | Balance | Balance | Balance |

The lubricating oil compositions of the present invention exhibit a reduced tendency to deteriorate under conditions of use and thereby reduce rust and corrosive wear and the formation of such undesirable deposits as varnish, sludge, carbonaceous materials and resinous materials which tend to adhere to the various engine parts and reduce the efficiency of the engines. Lubricating oils also can be formulated in accordance with this invention which result in improved fuel economy when used in the crankcase of a passenger automobile.

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

What is claimed is:

1. A process for preparing basic alkali metal salts of acidic organic compounds comprising the steps of (A) adding a portion of a basic alkali metal compound to a reaction mixture comprising a hydrocarbyl-substituted acidic organic compound wherein the hydrocarbyl group is derived from a polyalkene having a number average molecular weight of at least about 600 to form an alkali metal salt of the acidic compound, and removing free water from the reaction mixture, and thereafter, (B) adding another portion of a basic alkali metal compound to the reaction mixture; and (C) adding at least one inorganic or lower carboxylic acidic material to the reaction mixture while removing water from the reaction mixture, wherein at least steps (B) and (C) are conducted in the presence of a promoter.

2. The process of claim 1 wherein steps (B) and (C) are repeated at least once.

3. The process of claim 1 wherein the reaction temperature is from about 110° C. to about 200° C.

4. The process of claim 1 wherein the promoter is an alkyl or alkenyl phenol or a nitroalkane.

5. The process of claim 1 wherein the basic alkali metal compound is a basic sodium compound.

6. The process of claim 1 wherein the acidic organic composition contains at least one carboxylic acid.

7. The process of claim 1 wherein the hydrocarbyl group is derived from a polyalkene having an Mn of at least 900.

8. A process for preparing basic alkali metal salts of acidic organic compounds comprising the steps of:

(A) adding a portion of a basic alkali metal compound to a reaction mixture comprising a hydrocarbyl-substituted acidic organic compound wherein the hydrocarbyl group is derived from a polyalkene having a number average molecular weight of at least about 600 to form an alkali metal salt of the acidic compound, and removing free water from the reaction mixture, and thereafter, (B) concurrently (B-1) adding another portion of a basic alkali metal compound to the reaction mixture;

(B-2) adding at least one inorganic or lower carboxylic acidic material to the reaction mixture; and (B-3) removing water from the reaction mixture, wherein at least steps (B-1), (B-2) and (B-3) are conducted in the presence of a promoter.

9. The process of claim 8 wherein the reaction temperature is from about 110° C. to about 200° C.

10. The process of claim 8 wherein the promoter is an alkyl or alkenyl phenol or a nitroalkane.

11. The process of claim 8 wherein the basic alkali metal compound is a basic sodium compound.

12. The process of claim 8 wherein the acidic organic composition contains at least one carboxylic acid.

13. The process of claim 8 wherein the hydrocarbyl group is derived from a polyalkene having an Mn of at least 900.

14. A basic alkali metal salt of a hydrocarbyl-substituted acidic organic compound prepared by the process comprising the steps of (A) adding a portion of a basic alkali metal compound to a reaction mixture comprising a hydrocarbyl-substituted acidic organic compound wherein the hydrocarbyl group is derived from a polyalkene having a number average molecular weight of at least about 600 to form an alkali metal salt of the acidic compound, and removing free water from the reaction mixture, and thereafter, (B) adding another portion of a basic alkali metal compound to the reaction mixture; and (C) adding at least one inorganic or lower carboxylic acidic material to the reaction mixture while removing water from the reaction mixture, wherein at least steps (B) and (C) are conduct in the presence of a promoter.

15. The basic salt of claim 14 wherein steps (B) and (C) are repeated at least once.

16. The basic salt of claim 14 wherein the basic alkali metal compound is a basic sodium compound.

17. The basic salt of claim 14 wherein the acidic organic composition contains at least one carboxylic acid.

18. The basic salt of claim 14 wherein the hydrocarbyl group is derived from a polyalkene having an $\overline{Mn}$ of at least 900.

19. A basic alkali metal salt of a hydrocarbyl-substituted acidic organic compound prepared by the process comprising the steps of (A) adding a portion of a basic alkali metal compound to a reaction mixture comprising a hydrocarbyl-substituted acidic organic compound wherein the hydrocarbyl group is derived from a polyalkene having a number average molecular weight of at least about 600 to form an alkali metal salt of the acidic compound, and removing free water from the reaction mixture, and thereafter, (B) concurrently (B-1) adding another portion of a basic alkali metal compound to the reaction mixture;

(B-2) adding at least one inorganic or lower carboxylic acidic material to the reaction mixture; and (B-3) removing water from the reaction mixture, wherein at least steps (B-1), (B-2) and (B-3) are conducted in the presence of a promoter.

20. The basic salt of claim 19 wherein the promoter is an alkyl or alkenyl phenol.

21. The basic salt of claim 19 wherein the basic salt is a sodium salt.

22. The basic salt of claim 19 wherein the acidic organic composition contains at least one carboxylic acid.

23. The basic salt of claim 19 wherein the hydrocarbyl group is derived from a polyalkene having an $\overline{Mn}$ of at least about 900.

24. A composition comprising at least one borated alkali metal overbased salt of at least one hydrocarbyl-substituted acidic organic compound wherein the hydrocarbyl group is derived from a polyalkene having a number average molecular weight of at least about 600 and wherein the alkali metal overbased salt is prepared by the process comprising the steps of (A) adding a portion of a basic alkali metal compound to a reaction mixture comprising a hydrocarbyl-substituted acidic organic compound wherein the hydrocarbyl group is derived from a polyalkene having a number average molecular weight of at least about 600 to form an alkali metal salt of the acidic compound and removing free water from the reaction mixture, and thereafter, (B) adding another portion of a basic alkali metal compound to the reaction mixture; and (C) adding at least one inorganic or lower carboxylic acidic material to the reaction mixture while removing water from the reaction mixture, wherein least steps (B) and (C) are conducted in the presence of a promoter.

25. The composition of claim 24 wherein the basic salt has a metal ratio from about 1.5 to about 40.

26. The composition of claim 24 wherein the basic salt has a metal ratio from about 9 to about 25.

27. The composition of claim 24 wherein the polyalkene has an $\overline{Mn}$ from about to about 5000.

28. The composition of claim 24 wherein the polyalkene has an $\overline{Mn}$ from about to about 1500.

29. The composition of claim 24 wherein the polyalkene is polybutene.

30. The composition of claim 24 wherein the basic salt is an overbased succinate.

31. The composition of claim 24 wherein the basic salt is a sodium overbased succinate.

32. A composition comprising at least one borated alkali metal overbased salt of at least one acid selected from the group consisting of hydrocarbyl-substituted carboxylic acid or anhydride thereof, or phosphorus acid or anhydride thereof wherein the hydrocarbyl group is derived from a polyalkene having a number average molecular weight of at least 900.

33. The composition of claim 32 wherein the alkali metal is sodium.

34. The composition of claim 32 wherein the acid is at least one carboxylic acid or anhydride.

35. A lubricating composition comprising a major amount of an oil of lubricating viscosity and the basic alkali metal salt of claim 14.

36. A lubricating composition comprising a major amount of an oil of lubricating viscosity and the basic alkali metal salts of claim 19.

37. A lubricating composition comprising a major amount of an oil of lubricating viscosity and the composition of claim 24.

38. A lubricating composition comprising a major amount of an oil of lubricating viscosity and the composition of claim 32.

39. The composition of claim 35 wherein the lubricating composition further comprises (B) at least one dispersant.

40. A process for preparing basic alkali metal salts of acidic organic compounds comprising the steps of (A) adding a portion of a basic alkali metal compound which is at least a stoichiometric excess to a reaction mixture comprising a hydrocarbyl-substituted acidic organic compound wherein the hydrocarbyl group is derived from a polyalkene having a number average molecular weight of at least about 600, and a promoter, and removing free water from the reaction mixture;

(B) adding at least one inorganic or lower carboxylic acidic material to the reaction mixture while removing free water from the reaction mixture;

(c) adding another portion of the basic alkali metal compound to the reaction mixture; and (D) adding at least one inorganic or lower carboxylic acidic material to the reaction mixture while removing water from the reaction mixture.

41. The process of claim 40 wherein steps (C) and (D) are repeated at least once.

42. The process of claim 40 wherein the promoter has a pka from about 7 to about 10.

43. The process of claim 40 wherein the promoter is an alkyl or alkenyl phenol or a nitroalkane.

44. The process of claim 40 wherein the basic alkali metal compound is a basic sodium compound.

45. The process of claim 40 wherein the acidic organic composition contains at least one carboxylic acid.

46. A basic alkali metal salt of a hydrocarbyl-substituted acidic organic compound prepared by the process comprising the steps of (A) adding a portion of a basic alkali metal compound which is at least a stoichiometric excess to a reaction mixture comprising a hydrocarbyl-substituted acidic organic compound wherein the hydrocarbyl group is derived from a polyalkene having a number average molecular weight of at least about 600, and a promoter, and removing free water from the reaction mixture;

(B) adding at least one inorganic or lower carboxylic acidic material to the reaction mixture while removing free water from the reaction mixture;

(C) adding another portion of the basic alkali metal compound to the reaction mixture; and (D) adding at least one inorganic or lower carboxylic acidic material to the reaction mixture while removing water from the reaction mixture.

47. The basic salt of claim 46 wherein steps (C) and (D) are repeated at least once.

48. The basic salt of claim 46 wherein the promoter is an alkyl or alkenyl phenol or a nitroalkane.

49. The basic salt of claim 46 wherein the basic alkali metal compound is a basic sodium compound.

50. The basic salt of claim 46 wherein the acidic organic composition contains at least one carboxylic acid.

51. A composition comprising at least one borated alkali metal overbased salt of at least one hydrocarbyl-substituted acidic organic compound wherein the hydrocarbyl group is derived from a polyalkene having a number average molecular weight of at least about 600 and wherein the alkali metal overbased salt is prepared by the process comprising the steps of (A) adding a portion of a basic alkali metal compound which is at least a stoichiometric excess to a reaction mixture comprising a hydrocarbyl-substituted acidic organic compound wherein the hydrocarbyl group is derived from a polyalkene having a number average molecular weight of at least about 600, and a promoter, and removing free water from the reaction mixture;

(B) adding at least one inorganic or lower carboxylic acidic material to the reaction mixture while removing free water from the reaction mixture;

(C) adding another portion of the basic alkali metal compound to the reaction mixture; and (D) adding at least one inorganic or lower carboxylic acidic material to the reaction mixture while removing water from the reaction mixture.

52. The composition of claim 51 wherein the basic salt has a metal ratio from about 1.5 to about 40.

53. The composition of claim 51 wherein the polyalkene has an $\overline{M}n$ from about to about 5000.

54. The composition of claim 51 wherein the basic salt is an overbased succinate.

55. The composition of claim 51 wherein the basic salt is a sodium overbased succinate.

56. A lubricating composition comprising a major amount of an oil of lubricating viscosity and the basic alkali metal salt of claim 46.

* * * * *